US006169237B1

(12) United States Patent
Sanders

(10) Patent No.: US 6,169,237 B1
(45) Date of Patent: Jan. 2, 2001

(54) SCRATCH BOARD MUSICAL INSTRUMENT AND PLAYING IMPLEMENT

(76) Inventor: Harold E. Sanders, P.O. Box 6057, Titusville, FL (US) 32782

( * ) Notice: Under 35 U.S.C. 154(b), the term of this patent shall be extended for 0 days.

(21) Appl. No.: 09/395,814

(22) Filed: Sep. 14, 1999

(51) Int. Cl.[7] ..... G10D 13/08

(52) U.S. Cl. ..... 84/402; 84/403; 84/404; 84/102

(58) Field of Search ..... 84/402, 403, 404, 84/410, 102; D17/22, 99; 446/418, 397; 68/224, 228

(56) References Cited

U.S. PATENT DOCUMENTS

| | | | | |
|---|---|---|---|---|
| D. 237,448 | | 11/1975 | Sunday | D7/5 |
| D. 254,230 | | 2/1980 | Sanger | D7/201 |
| D. 259,993 | | 7/1981 | Kunze | D7/201 |
| D. 325,295 | | 4/1992 | Shepard | D2/643 |
| D. 326,470 | | 5/1992 | Broussard | D17/99 |
| D. 384,186 | | 9/1997 | Teaman | D2/643 |
| 1,433,431 | | 10/1922 | Thomas | 68/228 |
| 1,965,996 | * | 7/1934 | Wilder | 446/397 |
| 3,890,812 | * | 6/1975 | Sunday | 68/224 |
| 5,529,526 | * | 6/1996 | Wesley | 446/397 |

* cited by examiner

*Primary Examiner*—Robert E. Nappi
*Assistant Examiner*—Shih-yung Hsieh
(74) *Attorney, Agent, or Firm*—Edward M. Livingston, Esq.

(57) ABSTRACT

A scratch board musical instrument (1) and playing implement (2) having a playing surface (5) with a plurality of horizontal ripples, ridges and valleys (8, 6, 7), a border (9) surrounding the playing surface and a handle (4) on one side for holding the musical instrument by hand. The playing implement (2) has a handle (12) with a metal rod (13) extending therefrom which is bent or curved at a distal end to provide a surface on each side for running the rod transversely across the horizontal ridges to produce a "bluegrass" musical effect.

7 Claims, 2 Drawing Sheets

SCRATCH BOARD MUSICAL INSTRUMENT AND PLAYING IMPLEMENT

BACKGROUND OF THE INVENTION

This invention relates to musical instruments and more particularly, a scratch board instrument which yields a "bluegrass" musical effect when played with the implement of this invention to the beat of music.

Musical instruments having a playing surface made of rigid metal similar to a washboard are sometimes used in bluegrass music. Normally a utensil, like a spoon or knife, is rubbed against the ridges of the playing surface to the beat of music. Unfortunately, playing such musical instruments with utensils yields an inconsistent musical effect. Thus, there is a need for a scratch board musical instrument with a playing implement or striker that provides a consistent musical accompaniment.

The prior art includes washboard-like musical instruments, but none like the present invention with a novel playing implement. For instance, U.S. Pat. No. Des 326,470 issued to Broussard on May 26, 1992, discloses a musical type instrument with wavy ridges, but the ridges do not have ripples and there is no playing implement or striker provided. U.S. Pat. No. Des 384,186 issued to Teaman on Sep. 30, 1997 shows a button fastener which could be used as a striker with a washboard-type instrument, but it is different from the present invention. U.S. Pat. No. Des. 254,230 issued to Sanger on Feb. 19, 1980 discloses a design for a washboard with wavy lines and ridges, but does not include a striker. U.S. Pat. No. Des. 259,993 issued to Kunze on Jul. 28, 1981, shows yet another washboard. U.S. Pat. No. Des. 325,295 issued to Shepard on Apr. 14, 1992 discloses a design for another button remover, but is different from the playing implement of the present invention. U.S. Pat. No. 1,433,431 issued to Thomas on Oct. 24, 1922 shows yet another washboard. U.S. Pat. No. Des. 237,448 issued to Sunday on Nov. 4, 1975 and U.S. Pat. No. 1,987,232 issued to Gilbert on Jan. 8, 1935, disclose other washboards.

SUMMARY OF THE INVENTION

A major object of the present invention is to provide a scratch board musical instrument with a playing implement or striker that can be used therewith.

An ancillary object of the present invention to provide such a musical instrument and playing implement that would yield a consistent musical effect.

Another object of the present invention is to provide such a musical instrument which can be hand held and does not require a strap to hold around the neck of a musician.

A further object of the present invention is to provide such a scratch board-type musical instrument and playing implement that is easy to learn and use.

The present invention fulfills the above and other objects by providing a scratch board musical instrument and playing implement that produces a "bluegrass" musical effect when the playing instrument is scratched against the playing surface of the instrument. The playing surface of the instrument has a playing surface with a plurality of ridges and valleys. The ridges have a plurality of ripples alone the crest of each ridge. The playing surface is surrounded by a border which holds the playing surface firmly in place. A handle on one side of the border allows the musical instrument to be held by hand. The playing implement has a handle with a rod extending from one end which has a tip at a distal end for scratching against the musical instrument. The tip is bent to form a curved portion which can be used to run across the ridges of the musical instrument. The tip on the distal end of the playing surface may also be curved. Although the horizontal rippled ridges and valleys on the playing surface of the musical instrument may follow any pattern, they would preferably be alternating.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
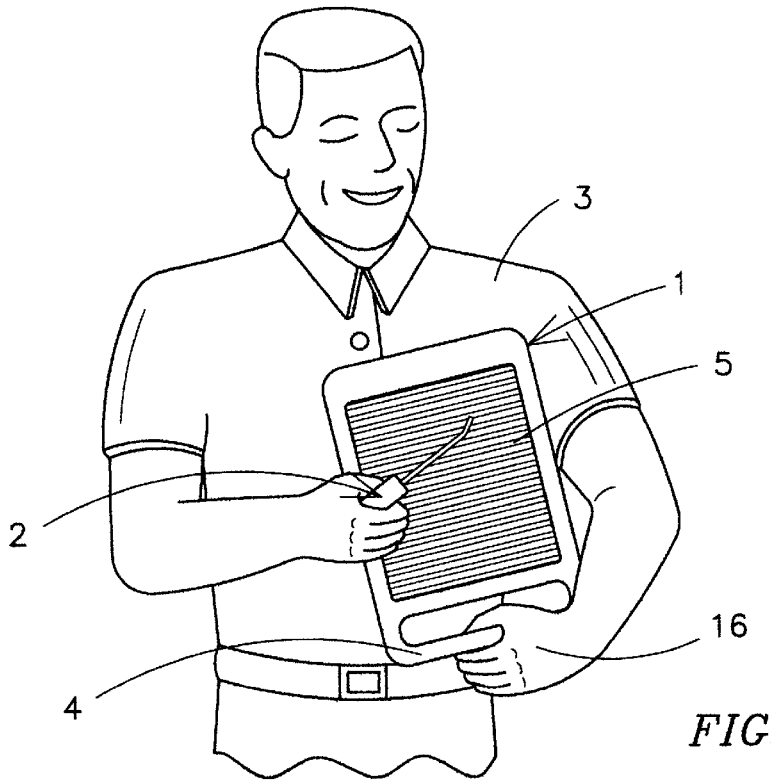
FIG. 1 is a perspective view showing the musical instrument and playing implement of the present invention being played by a musician.

For purposes of describing the preferred embodiment, the terminology used in reference to the numbered components in the drawings is as follows:

1. scratch board musical instrument
2. playing implement or striker surface
3. musician
4. handle
5. ridged playing surface
6. ridges
7. valleys between ridges
8. ripples
9. border
10. hand hole
11. Holding channel for playing
12. handle for striker
13. playing striker rod
14. bent playing tip
15. curled playing tip
16. musician's hand Referring now to the drawings, as shown in FIG. 1 the scratch board musical instrument 1 is shown being held by the handle 4 in the hands of the musician 3 with the other hand of the musician holding a musical instrument or striker 2 and rubbing against a ridged playing surface 5 on both sides of the instrument.

Figure 2:
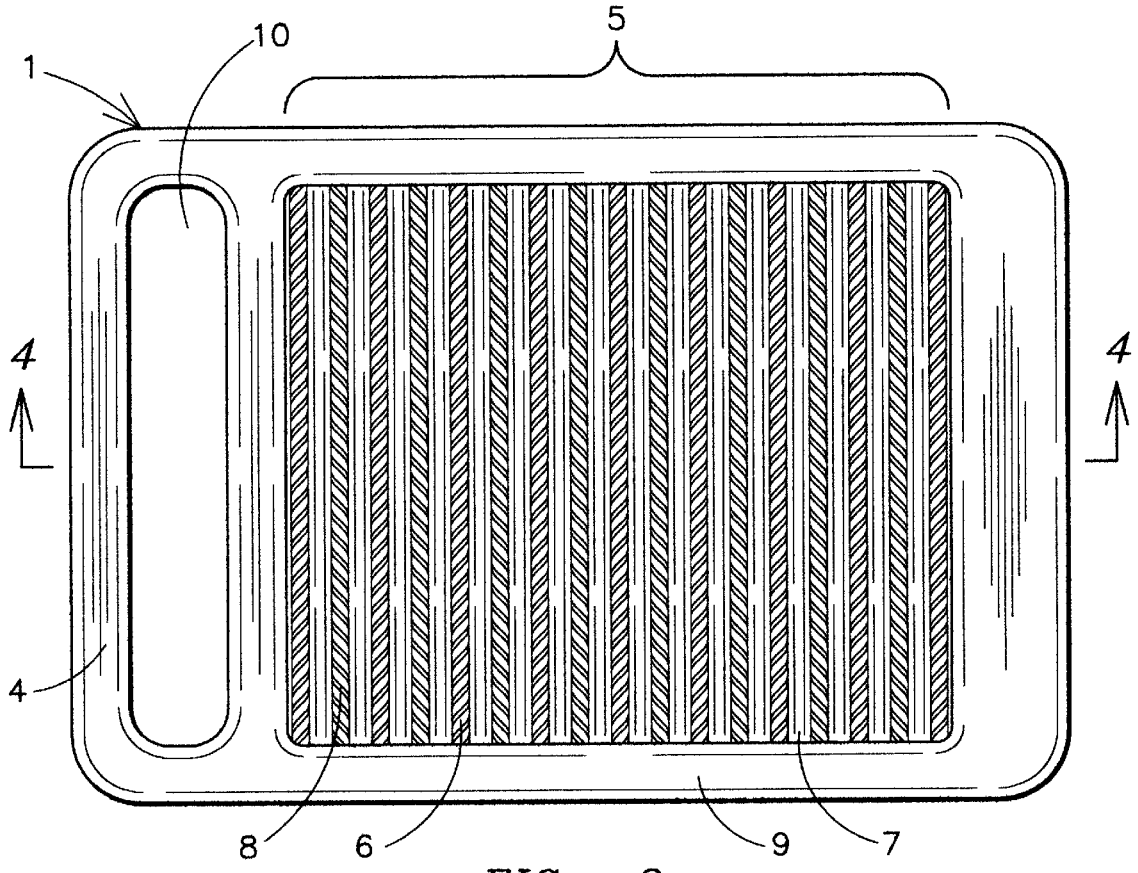
FIG. 2 is an elevational view of the scratch board musical instrument.

FIG. 2 shows the musical instrument 1 by itself. The playing surface 5 has a plurality of alternating ridges 6 and valleys 7. The ridges 6 contain a plurality of ripples 8 along the crest of each ridge 6. The playing surface 5 is surrounded by a border 9 which has a handle 4 with hand hole 10 through which a musician's hand can be placed to hold the instrument in the proper playing position.

Figure 3:
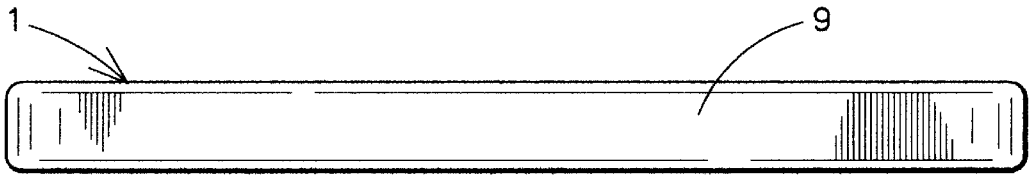
FIG. 3 is a side view of the scratch board musical instrument.

FIG. 3 shows a side view of the musical instrument 1 with border 9.

Figure 4:
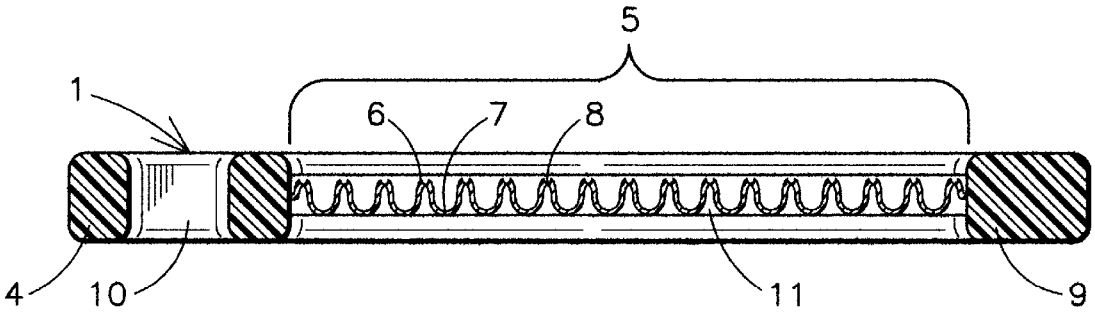
FIG. 4 is a side cross-sectional view of the scratch board musical instrument along the lines 4—4 of FIG. 2.

In FIG. 4 the structure of the playing surface 5 is best illustrated showing the alternating ridges 6 and valleys 7 with the ripples 8 on the crest of the ridges 6. The playing surface 5 is held rigidly in a channel 11 cut into the inside of the border 9. The playing surface may be made of almost any metal, such as galvanized steel or aluminum and will produce different musical effects depending on what it is made of. The playing surface could even be made of plastic if desired. The border 9 could be made of almost any rigid material, such as wood or plastic.

Figure 5:
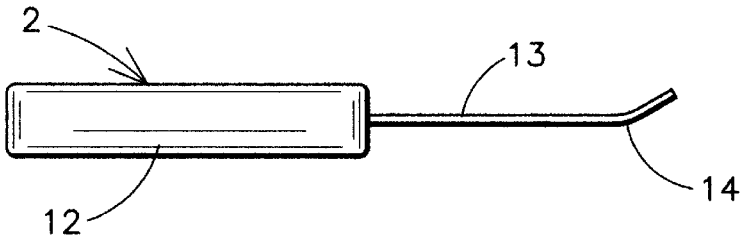
FIG. 5 is a side view of the playing implement or striker used to play the scratch board musical instrument.
Figure 6:
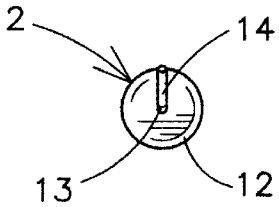
FIG. 6 is a front end view of the playing implement or striker.

The playing implement or striker is illustrated in FIGS. 5 and 6. FIG. 5 shows the striker 2 having a handle 12 with striker rod 13 and a bent playing tip at its distal end.

Figure 7:
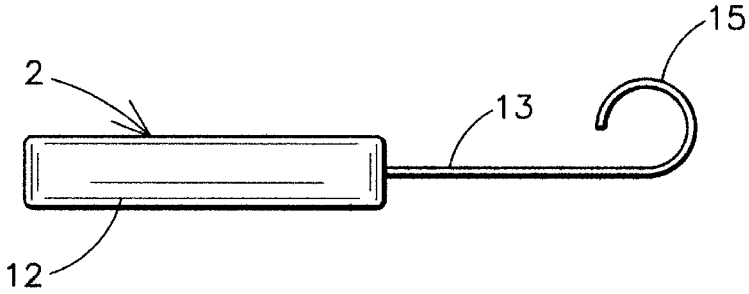
FIG. 7 is a side view of another embodiment of the playing implement or striker.

FIG. 7 shows a slightly different embodiment of the striker having a curled playing tip 15 at its distal end. The bent playing tip 14 or curled playing tip 15 of the playing implement or striker allows the musical instrument to be played to produce a "bluegrass" musical effect, rather than a scratchy irritating noise that may produce if just merely a sharp tip of a rod were used.

Although only a few embodiments of the present invention have been described in detail hereinabove, all improvements and modifications to this invention within the scope or equivalents of the claims are included as part of this invention.

Having thus described my invention, I claim:

1. A scratch board musical instrument and playing implement comprising:

at least one playing surface having a plurality of horizontal ridges and valleys, said ridges having a plurality of ripples along a crest of each ridge;

a border surrounding and holding the at least one playing surface rigidly in place;

a handle, on one side of the border for holding the musical instrument by hand; and a playing implement with a handle having a rod extending therefrom with a tip at a distal end having a bend to provide a curved portion for scratching against the at least one playing surface to yield an accompanying musical sound.

2. The scratch board musical instrument of claim 1 wherein the ridges and valleys on the at least one playing surface are alternating.

3. The scratch board musical instrument of claim 2 wherein the playing surface is held rigidly in place by channels cut into an inner side of the border to hold each side of the at least one playing surface.

4. The scratch board musical instrument of claim 1 wherein the playing surface is held rigidly in place by channels cut into an inner side of the border to hold each side of the at least one playing surface.

5. A scratch board musical instrument and playing implement comprising:

at least one playing surface having a plurality of horizontal ridges and valleys, said ridges having a plurality of ripples along a crest of each ridge;

a border surrounding and holding the at least one playing surface rigidly in place;

a handle on one side of the border for holding the musical instrument by hand; and a playing implement with a handle having a rod extending therefrom with a tip at a distal end being curled for scratching against the at least one playing surface to yield an accompanying musical sound.

6. The scratch board musical instrument of claim 5 wherein the ridges and valleys on at least one playing surface are alternating.

7. The scratch board musical instrument of claim 5 wherein the playing surface is held rigidly in place by channels cut into an inner side of the border to hold each side of the at least one playing surface.

* * * * *